US009459581B2

(12) United States Patent
Takeuchi

(10) Patent No.: US 9,459,581 B2
(45) Date of Patent: Oct. 4, 2016

(54) IMAGE FORMING APPARATUS

(71) Applicant: KYOCERA Document Solutions Inc., Osaka (JP)

(72) Inventor: Naoki Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/979,471

(22) Filed: Dec. 27, 2015

(65) Prior Publication Data

US 2016/0187833 A1 Jun. 30, 2016

(30) Foreign Application Priority Data

Dec. 26, 2014 (JP) ..... 2014-265867

(51) Int. Cl.
*G03G 15/00* (2006.01)

(52) U.S. Cl.
CPC ..... *G03G 15/70* (2013.01)

(58) Field of Classification Search
CPC ..... G03G 15/70
USPC ..... 399/21
See application file for complete search history.

(56) References Cited

U.S. PATENT DOCUMENTS 5,393,043 A * 2/1995 Nitta ..... G03G 15/6502 271/259
5,678,123 A * 10/1997 Kim ..... G03G 15/70 271/256
5,963,755 A * 10/1999 Ueda ..... G03G 15/6508 271/288
6,032,944 A * 3/2000 Lee ..... B41J 29/393 271/110
8,626,050 B2 * 1/2014 Takahashi ..... B41J 11/0095 271/9.01
2010/0092189 A1 * 4/2010 Shimizu ..... G03G 15/5029 399/43
2012/0093526 A1 * 4/2012 Yasui ..... B41J 3/46 399/21
2013/0272725 A1 * 10/2013 Tanaka ..... G03G 15/70 399/21
2015/0277323 A1 * 10/2015 Yamazaki ..... G03G 15/5012 399/21

FOREIGN PATENT DOCUMENTS

JP 2005-145624 A 6/2005

* cited by examiner

*Primary Examiner* — Anthony Nguyen
(74) *Attorney, Agent, or Firm* — Hawaii Patent Services; Nathaniel K. Fedde; Kenton N. Fedde

(57) ABSTRACT

Provided is an image forming apparatus performing automatic recovery from a paper non-feeding jam. It includes plural paper feeding cassettes, a sensing sensor, paper non-feeding jam determining part, and system control part. Plural paper feeding cassettes are detachably loaded inside apparatus main body. Sensing sensor is disposed in a carrying passage, and senses a paper sheet fed from paper feeding cassette. Paper non-feeding jam determining part determines whether or not a paper non-feeding jam has occurred in paper feeding cassette, on apparatus operation state and result of sensing by sensing sensor, and if a paper non-feeding jam has occurred, releases error state for paper non-feeding jam after a prescribed time period has elapsed, notifying that paper feeding is to be changed over. System control part controls changeover of paper feeding to that from another paper feeding cassette, on notification from paper non-feeding jam determining part.

5 Claims, 3 Drawing Sheets

IMAGE FORMING APPARATUS

INCORPORATION BY REFERENCE

This application is based on and claims the benefit of priority from Japanese Patent Application No. 2014-265867 filed on Dec. 26, 2014, the contents of which are hereby incorporated by reference.

BACKGROUND

The present disclosure relates to an image forming apparatus that reads a document to generate image data.

For example, typical image forming apparatuses that are an MFP (Multifunction Peripheral) are often provided with an automatic paper feeding mechanism part that feeds paper sheets stored in a paper feeding cassette one by one to a carrying passage for guiding the fed paper sheet to a printing mechanism part.

In addition, with some typical image forming apparatuses, there are provided with a cassette detection sensor that detects the state in which the paper feeding cassette has been drawn out from the apparatus main body, that is, an open state, and the state in which the paper feeding cassette is loaded in the apparatus main body, that is, a closed state, and a paper sheet detection sensor that detects whether or not paper sheet is stored in the paper feeding cassette.

In addition, with some typical image forming apparatuses, there is provided with a plurality of paper feeding cassettes such that, when the paper sheets in any one of the paper feeding cassette have run out, the paper feeding can be changed over to that from another paper feeding cassette.

In other words, with such typical image forming apparatuses, the plurality of sheet storage means that are grouped are disposed, being vertically stacked. Then, when the paper sheets stored in the sheet storage means that is in the course of paper feeding have run out, the paper feeding is changed over to that from another sheet storage means in the same group.

SUMMARY

An image forming apparatus of an embodiment of the present disclosure includes a plurality of paper feeding cassettes, a sensing sensor, a paper non-feeding jam determining part, and a system control part. The plurality of paper feeding cassettes are loaded in the inside of an apparatus main body in a detachable manner. The sensing sensor is disposed in a carrying passage from the paper feeding cassette, sensing a paper sheet fed from the paper feeding cassette. The paper non-feeding jam determining part performs processing to determine whether or not a paper non-feeding jam has occurred in the paper feeding cassette, on the basis of the operation state of the apparatus and the result of sensing by the sensing sensor, and in the event that there has occurred a paper non-feeding jam, performs processing to release the error state for the paper non-feeding jam after a prescribed period of time has elapsed, and performs processing to give a notification that the paper feeding is to be changed over. The system control part performs processing to control changeover of paper feeding to that from another paper feeding cassette on the basis of the notification from the paper non-feeding jam determining part.

DETAILED DESCRIPTION

Figure 2:
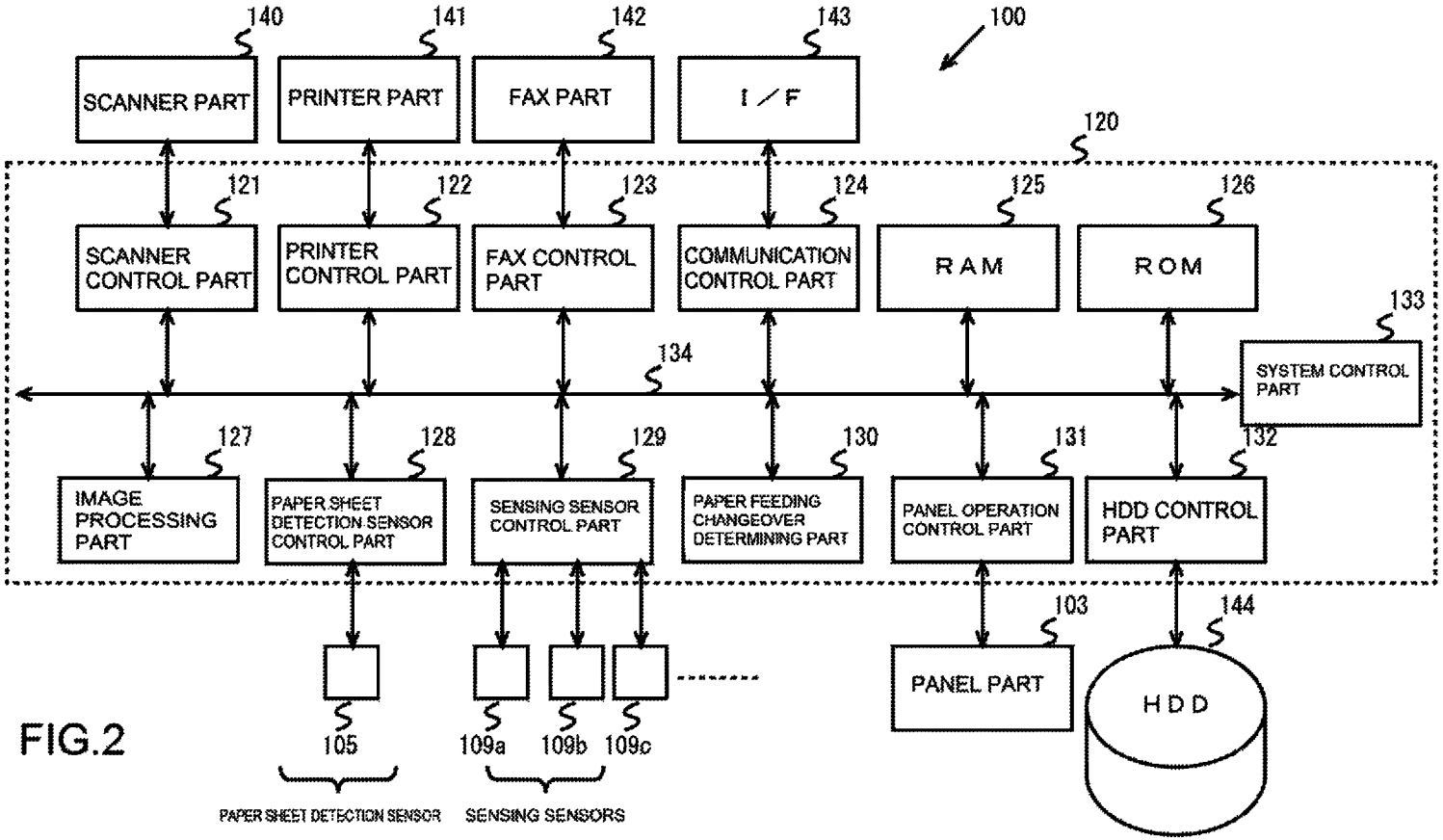
FIG. 2 illustrates a configuration of the MFP in FIG. 1.
Figure 3:
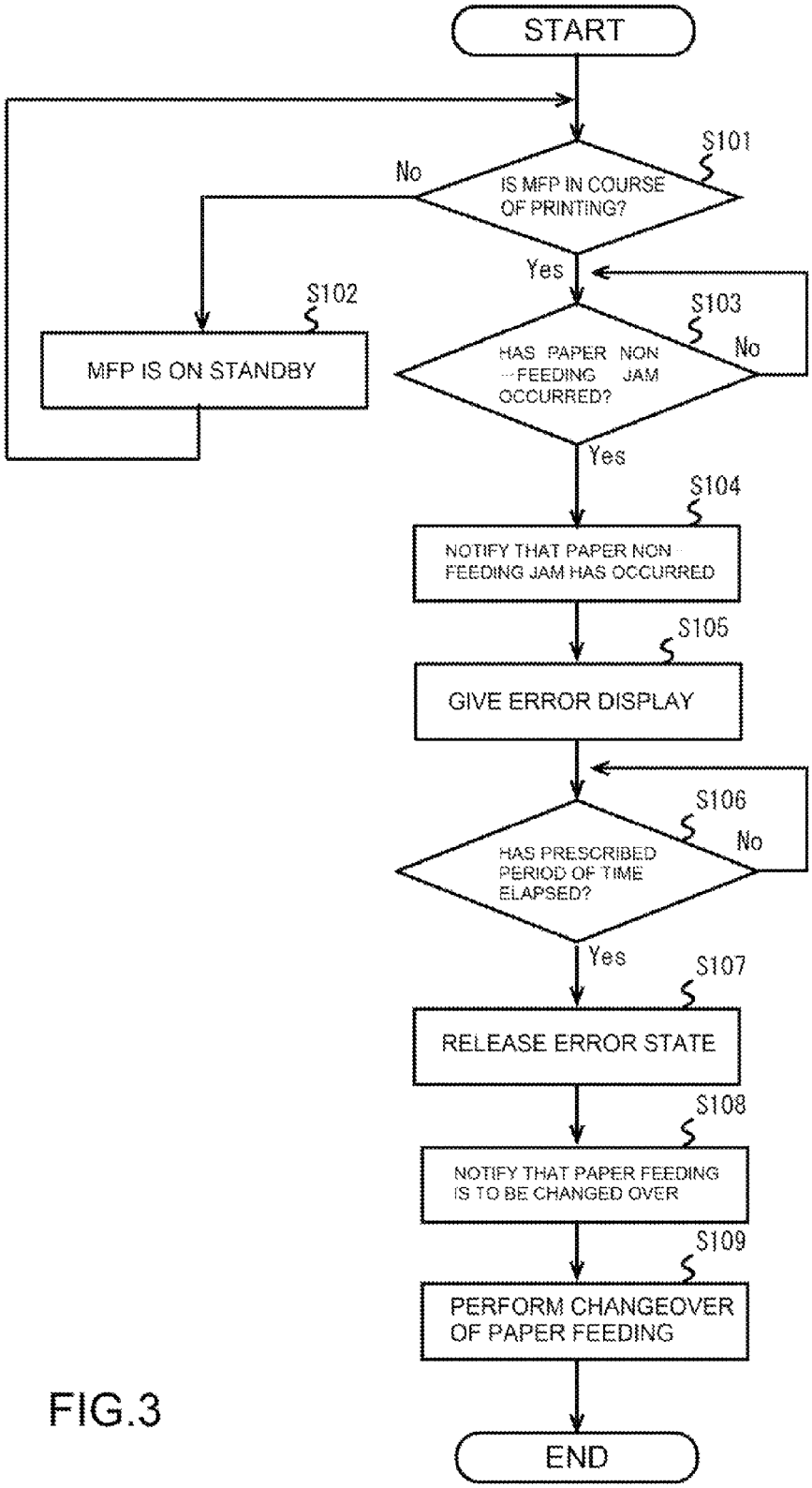
FIG. 3 illustrates the steps of operation for automatic recovery by the MFP in FIG. 1 at the time of occurrence of a paper non-feeding jam.

Hereinbelow, an embodiment of an image forming apparatus of the present disclosure will be explained with reference to FIG. 1 to FIG. 3. In the following explanation, as an example of the image forming apparatus, the image forming apparatus is assumed to be an MFP (Multifunction Peripheral) that provides multiple operation functions for such jobs as copying, printing, and facsimiling.

Figure 1:
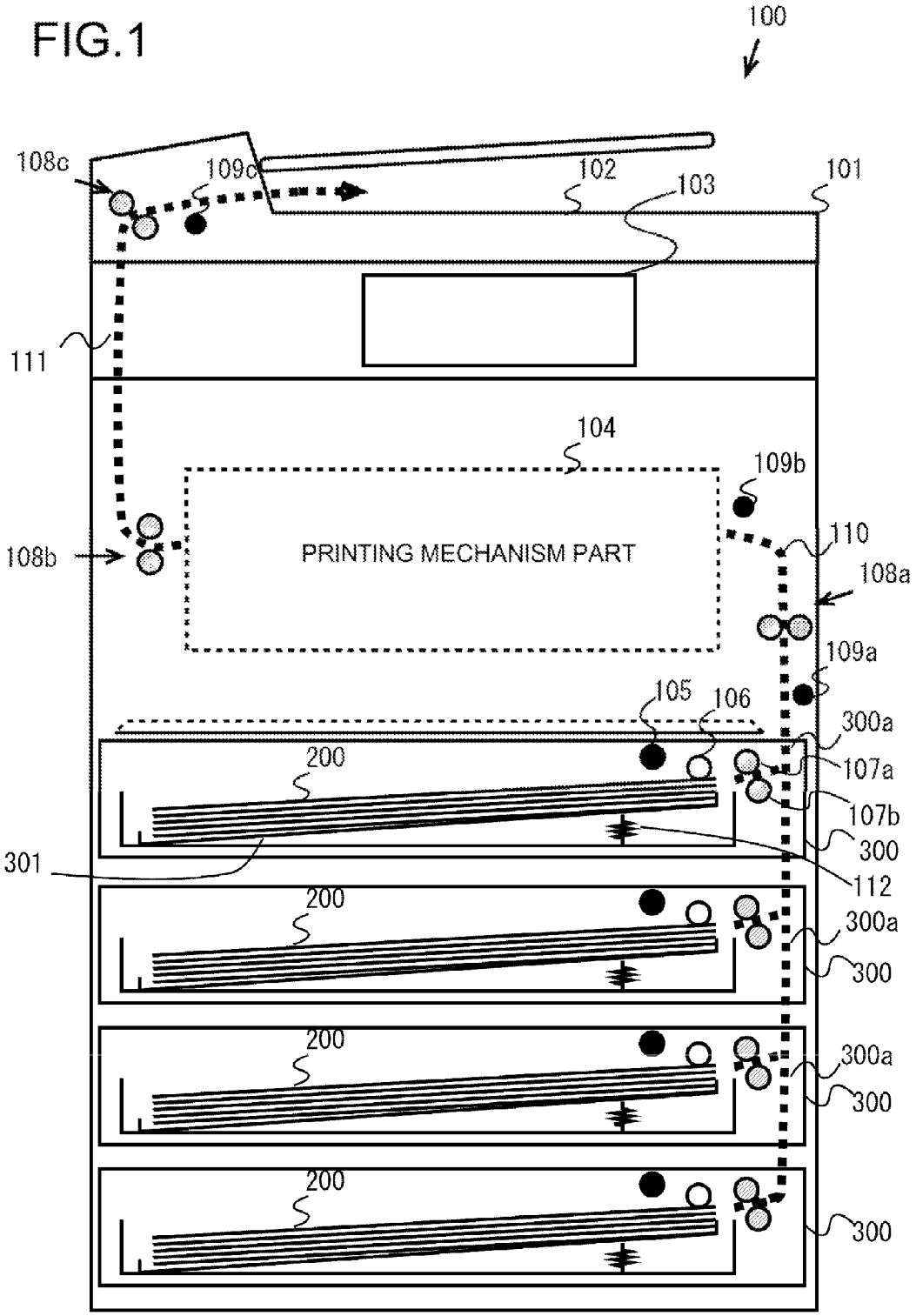
FIG. 1 shows an embodiment in the case where the image forming apparatus in the present disclosure is assumed to be an MFP.

First, as shown in FIG. 1, in an MFP 100, a paper delivery tray 102 and a panel part 103 are provided in the upper part of an MFP main body 101. In addition, in the inside of the MFP main body 101, a printing mechanism part 104 having such components as a photosensitive drum is disposed. Under the printing mechanism part 104, a plurality of paper feeding cassettes 300, which store a plurality of paper sheets 200, are disposed, being stacked along a vertical direction. In addition, these paper feeding cassettes 300 are detachable from the MFP main body 101. In addition, for each paper feeding cassette 300, there is provided with a common carrying passage 300*a*, which is also used for a paper sheet 200 that is fed from a paper feeding cassette 300 located at a lower stage.

In addition, in the inside of the MFP main body 101, there are disposed a paper sheet detection sensor 105, a feeding roller 106, a driving roller 107*a*, and a driven roller 107*b*. These paper sheet detection sensor 105, feeding roller 106, driving roller 107*a*, and driven roller 107*b* are disposed in correspondence to the loading position of the respective paper feeding cassettes 300. The paper sheet detection sensor 105 may be mechanical or optical one.

In addition, in the inside of the MFP main body 101, there are provided a sensing sensor 109*a*, conveyance rollers 108*a*, a sensing sensor 109*b*, conveyance rollers 108*b* and 108*c*, and a sensing sensor 109*c*. The sensing sensor 109*a*, the conveyance rollers 108*a*, and the sensing sensor 109*b* are disposed along a carrying passage 110 from the respective paper feeding cassettes 300 to the printing mechanism part 104. In addition, the conveyance rollers 108*b* and 108*c*, and the sensing sensor 109*c* are provided along a carrying passage 111 from the printing mechanism part 104 to the paper delivery tray 102.

In the paper feeding cassette 300, there is provided a lifting plate 301, which is pushed up at a place opposed to the feeding roller 106 by a lifting member 112, which is provided in the inside of the MFP main body 101.

Then, with the lifting plate 301 being pushed up by the lifting member 112, the distal end portion of the paper sheet 200 on the lifting plate 301 is pressed against the feeding roller 106. Thereby, the paper sheets 200 in the paper feeding cassette 300 are fed out one by one by the feeding roller 106. In addition, in the state in which the distal end portion of the paper sheet 200 on the lifting plate 301 is pushed up, detection of the paper sheet 200 by the paper sheet detection sensor 105 is performed. Here, if the paper sheet detection sensor 105 detects the paper sheet 200 that is stored in the paper feeding cassette 300, the paper sheet detection sensor 105 detects paper sheet presence. Contrarily, if the paper sheet detection sensor 105 cannot detect the paper sheet 200 that is stored in the paper feeding cassette 300, the paper sheet detection sensor 105 detects paper sheet absence. Specifically, if no paper sheet 200 is stored in the paper feeding cassette 300, the paper sheet detection sensor 105 detects paper sheet absence. Further, if the paper feeding cassette 300 is in the open state, the paper sheet detection sensor 105 cannot detect any paper sheet 200, which is to be stored in the paper feeding cassette 300, and thus detects paper sheet absence, regardless of whether paper sheet 200 is stored in the paper feeding cassette 300.

The paper sheet 200 that has been fed by the feeding roller 106 is conveyed to the printing mechanism part 104 by the conveyance rollers 108*a* along the carrying passage 110. The paper sheet 200, which has been subjected to printing by the printing mechanism part 104, is conveyed to the paper delivery tray 102 by the conveyance rollers 108*b* and 108*c* along the carrying passage 111. In the case where, after the respective sensing sensors 109*a* to 109*c* having sensed the paper sheet 200, a specific period of time has elapsed without the paper sheet 200 being sensed, the conveyance of the paper sheet 200 is sensed by the respective sensing sensors 109*a* to 109*c*.

In addition, in the case where any one of the sensing sensors 109*a* to 109*c* has sensed the paper sheet 200, but there is no change in the result of sensing even if a specific period of time has elapsed (in other words, the conveyance of the paper sheet 200 has been kept sensed), it is determined that there has occurred a paper sheet jam in the place where the paper sheet 200 is sensed. In addition, particularly in the case where the sensing sensor 109*a*, which is disposed in a place close to the paper feeding cassette 300, has not sensed the paper sheet 200, it is determined that a paper non-feeding jam has occurred in the paper feeding cassette 300, and the conveyance of the paper sheet 200 is not sensed. In addition, in the case where the paper sheet 200 has not been sensed by the respective sensing sensors 109*a* to 109*c*, it is determined that there is no paper sheet 200 in the carrying passage 111, and thus the conveyance of the paper sheet 200 is not sensed. As the specific period of time, a period of time that is longer than is required for the paper sheet 200 to pass through the sensing sensors 109*a* to 109*c* is set. The specific period of time may be a fixed value, or a value that varies depending upon the size of the paper sheet to be conveyed.

In addition, as described above, the carrying passages 110 and 111 convey the paper sheet 200 from the respective paper feeding cassettes 300 to the paper delivery tray 102 through the printing mechanism part 104. The carrying passage 110 is continued to the common carrying passage 300*a*, which is used by the respective paper feeding cassettes 300.

In the present embodiment, although the details are later described, in the event that, in the course of printing, there has occurred a paper non-feeding jam in the paper feeding cassette 300, the error state for the paper non-feeding jam is released after a prescribed period of time has elapsed, and the paper feeding is changed over to that from, for example, a paper feeding cassette 300 at a lower stage. Ifapaper feeding cassette 300 located at an upper stage above the paper feeding cassette 300 with which a paper non-feeding jam has occurred stores paper sheets 200 that can be fed, the paper feeding may be changed over to that from the paper feeding cassette 300 located at the upper stage above the paper feeding cassette 300 with which a paper non-feeding jam has occurred.

Next, with reference to FIG. 2, the configuration of the MFP 100 will be explained. The MFP 100 includes a control part 120, a scanner part 140, a printer part 141, a FAX part 142, an I/F (interface) 143, a paper sheet detection sensor 105, sensing sensors 109*a* to 109*c*, a panel part 103, and an HDD (hard disk drive) 144.

The scanner part 140 inputs image data of a document read by an image sensor to the control part 120. In other words, the scanner part 140 converts an image signal for the document from the image sensor into digital image data, and sequentially inputs it to the control part 120.

The printer part 141 has the printing mechanism part 104, and on the basis of the image data outputted from the control part 120, prints an image on the paper sheet 200. The FAX part 142 transmits the image data outputted from the control part 120 to a facsimile on the opposite party through a telephone line, and receives image data from the facsimile on the opposite party to input it to the control part 120. In other words, the FAX part 142 compresses and modulates the image data outputted from the control part 120 to transmit it to the facsimile on the opposite party, while controlling the connection to the telephone line with an NCU (Network Control Unit). In addition, the FAX part 142 demodulates and expands the image data from the facsimile on the opposite party to input it to the control part 120, while connecting to the telephone line with the NCU.

The I/F 143 performs a communication with a client terminal, for example, through a network, such as an in-house LAN (Local Area Network).

The paper sheet detection sensor 105, as described above, detects the paper sheet 200 that is stored in the paper feeding cassette 300. The sensing sensors 109*a* to 109*c*, as described above, sense the paper sheet 200 that is conveyed along the carrying passages 110 and 111.

The panel part 103 is a circuitry, such as a touch panel that displays operation buttons, and the like, for selecting any one of the printer function, the FAX function, and the scanning function of the MFP 100, and performing various settings. In the HDD 144, application programs, and the like, for providing various functions of the MFP 100 are stored. In addition, in the HDD 144, a user box, and the like, are provided.

The control part 120 controls the entire operation of the MFP 100. The control part 120 includes a scanner control part 121, a printer control part 122, a FAX (facsimile) control part 123, a communication control part 124, an RAM (Random Access Memory) 125, an ROM (Read Only Memory) 126, an image processing part 127, a paper sheet detection sensor control part 128, a sensing sensor control part 129, a paper non-feeding jam determining part 130, a panel operation control part 131, an HDD control part 132, and a system control part 133. In addition, these are connected to a data bus 134. The scanner control part 121, the printer control part 122, the FAX (facsimile) control part 123, the communication control part 124, the image processing part 127, the paper sheet detection sensor control part 128, the sensing sensor control part 129, the paper non-feeding jam determining part 130, the panel operation control part 131, the HDD control part 132, and the system control part 133 include a processor, such as a Central Processing Unit (CPU), having one circuit or more, being capable of reading various programs to execute them, and executing various programs that have been previously incorporated in the inside. Here, the circuit can be an electronic part in which a plurality of electronic elements are connected by wiring, or an electronic substrate.

The scanner control part 121 controls the reading operation of the scanner part 140. The printer control part 122 performs processing to control the printing operation of the printer part 141. The FAX control part 123 controls the image data transmission/reception operation by the FAX part 142. The communication control part 124 performs processing to control the communication through the I/F 143.

The RAM 125 is a work memory for executing a program. The ROM 126 has an area for storing control programs, and the like, to perform operation check, and the like, of the respective parts. The image processing part 127 performs image processing for image data of a document read by, for example, the scanner part 140.

The paper sheet detection sensor control part 128 controls the paper sheet detection operation by the paper sheet detection sensor 105. The sensing sensor control part 129 controls the operation of sensing the paper sheet 200 by the sensing sensors 109*a* to 109*c*.

When the MFP 100 is in the course of printing, in the case where the sensing sensor 109*a*, which is disposed in a place close to the paper feeding cassette 300, has not sensed the paper sheet 200, the non-feeding jam determining part 130 performs processing to determine that a paper non-feeding jam has occurred in the paper feeding cassette 300. In addition, in the event that there has occurred a paper non-feeding jam, the non-feeding jam determining part 130 performs processing to notify the system control part 133 that there has occurred a paper non-feeding jam. In addition, in the event that there has occurred a paper non-feeding error, the non-feeding jam determining part 130 performs processing to release the error state for the paper non-feeding jam after a prescribed period of time has elapsed, and notify the system control part 133 that the paper feeding is to be changed over to that from another paper feeding cassette 300. The another paper feeding cassette 300 refers to a paper feeding cassette 300 located at a lower stage or an upper stage than the paper feeding cassette 300 with which a paper non-feeding error has occurred.

The panel operation control part 131 performs processing to control the display operation of the panel part 103. The HDD control part 132 performs processing to control the writing/reading of data into/from the HDD 144, and the like. The system control part 133 mainly performs processing to receive a notification from the non-feeding jam determining part 130 that a paper non-feeding jam has occurred, and cause the panel part 103, through the panel operation control part 131, to give an error display indicating that there has occurred a paper non-feeding jam. In addition, the system control part 133 performs processing to receive a notification from the non-feeding jam determining part 130 that the paper feeding is to be changed over to that from another paper feeding cassette 300, and change over the paper feeding to that from the another paper feeding cassette 300.

Next, with reference to FIG. 3, the operation of automatic recovery by the MFP 100 at the time of occurrence of a paper non-feeding jam will be explained. In the following explanation, it is assumed for convenience of explanation that, in the respective paper feeding cassettes 300, paper sheets 200 having the same size (for example, a size of A4) are stored.

First, the paper non-feeding jam determining part 130 determines whether or not the MFP 100 is in the course of printing (Step S101). If the MFP 100 is not in the course of printing (NO at Step S101), the paper non-feeding jam determining part 130 determines that the MFP 100 is on standby (Step S102).

Contrarily to this, if it is determined that the MFP 100 is in the course of printing (YES at Step S101), the paper non-feeding jam determining part 130 determines whether or not a paper non-feeding jam has occurred (Step S103). In other words, if, in the course of printing, the paper sheet 200 is sensed by the sensing sensor 109*a*, which is disposed in a place close to the paper feeding cassette 300, it is determined that there has not occurred a paper non-feeding jam (NO at Step S103). On the other hand, if, in the course of printing, the paper sheet 200 is not sensed by the sensing sensor 109*a*, which is disposed in a place close to the paper feeding cassette 300, it is determined that there has occurred a paper non-feeding jam (YES at Step S103).

In addition, in the event that there has occurred a paper non-feeding jam, the paper non-feeding jam determining part 130 notifies the system control part 133 that a paper non-feeding jam has occurred (Step S104). Then, the system control part 133 causes the panel part 103, through the panel operation control part 131, to give an error display indicating that there has occurred a paper non-feeding jam (Step S105). At this time, the system control part 133 causes the printer part 141, through the printer control part 122, to interrupt the printing once.

In addition, in the event that there has occurred a paper non-feeding jam, the paper non-feeding jam determining part 130 is brought into a standby state until a prescribed period of time elapses (NO at Step S106). Then, if it is determined that a prescribed period of time has elapsed (YES at Step S106) , the non-feeding jam determining part 130 releases the error state for the paper non-feeding jam (Step S107), and notify the system control part 133 that the paper feeding is to be changed over to that from another paper feeding cassette 300 (Step S108).

Here, the reason why the paper non-feeding jam determining part 130 is brought into a standby state until a prescribed period of time elapses is that, for each paper feeding cassette 300, there is provided with a common carrying passage 300*a*, which is also used for a paper sheet 200 that is fed from a paper feeding cassette 300 located at a lower stage. Therefore, if the paper feeding cassette 300 with which a paper non-feeding jam has occurred is drawn out from the MFP main body 101, paper feeding from a paper feeding cassette 300 located at a lower stage cannot be performed. Then, in consideration of the period of time from the moment when the paper feeding cassette 300 with which a paper non-feeding jam has occurred is drawn out from the MFP main body 101 to the moment when, after the paper sheet 200 having been reset, the paper feeding cassette 300 is returned to the MFP main body 101, the paper non-feeding jam determining part 130 is brought into a standby state until a prescribed period of time elapses.

The period of time during which the paper non-feeding jam determining part 130 is kept in a standby state can be arbitrarily set by operating the panel part 103. Accordingly, if the period of time during which the paper non-feeding jam determining part 130 is kept in a standby state is set short, the paper non-feeding jam determining part 130 can rapidly release the error state for the paper non-feeding jam.

Then, upon the system control part 133 having received a notification from the paper non-feeding jam determining part 130 that the paper feeding is to be changed over, the system control part 133 changes over the paper feeding to that from a paper feeding cassette 300 located at, for example, a lower stage than the paper feeding cassette 300 with which a paper non-feeding jam has occurred (Step S109). At this time, the system control part 133 causes the printer part 141, through the printer control part 122, to resume the printing.

In this way, in the present embodiment, on the basis of the operation state of the MFP 100 and the result of sensing by the sensing sensor 109*a* that is disposed in the carrying passage 110 from the paper feeding cassette 300, the paper non-feeding jam determining part 130 determines whether or not a paper non-feeding jam has occurred in the paper feeding cassette 300. Then, if it is determined that a paper non-feeding jam has occurred, the paper non-feeding jam determining part 130 releases the error state for the paper non-feeding jam after a predetermined period of time has elapsed, and notifies the system control part 133 that the paper feeding is to be changed over. Thereby, the system control part 133 controls changeover of the paper feed to that from another paper feeding cassette 300.

Thereby, in the event that there has occurred a paper non-feeding jam, even in the case where it has been made impossible to determine whether the paper feeding cassette is in the open state or the closed state, the paper non-feeding jam releases the error state for the paper non-feeding jam after a predetermined period of time has elapsed, and the system control part 133 controls changeover of the paper feeding to that from another paper feeding cassette. Thus, automatic recovery from the paper non-feeding jam can be performed.

Specifically, the paper feeding cassette 300 with which a paper non-feeding cassette has occurred may not be drawn out with the state as it is being continued. In such a case, after a predetermined period of time has elapsed, the error state for the paper non-feeding jam is released by the paper non-feeding jam determining part 130, and changeover of the paper feeding to that from another paper feeding cassette is controlled by the system control part 133, whereby automatic recovery from the paper non-feeding jam can be performed.

What is claimed is:

1. An image forming apparatus comprising:

a plurality of paper feeding cassettes that are loaded in a detachable manner in the inside of an apparatus main body;

a carrying passage through which paper sheets are fed from the plurality of paper feeding cassettes;

a sensing sensor that is disposed in the carrying passage, and senses conveyance of a paper sheet fed through the carrying passage;

a paper non-feeding jam determining part that, on the basis of the result of sensing by the sensing sensor, when the apparatus is in printing, performs processing to determine whether or not a paper non-feeding jam has occurred in a paper feeding cassette of the plurality, and in the event that there has occurred a paper non-feeding jam, performs processing to release the error state for the paper non-feeding jam after a prescribed period of time has elapsed, and performs processing to give a notification that paper feeding is to be changed over; and a system control part that, on the basis of the notification from the paper non-feeding jam determining part, performs processing to control changeover of paper feeding to paper feeding from another paper feeding cassette.

2. The image forming apparatus according to claim 1, wherein the system control part performs processing to control changeover of paper feeding to that from a paper feeding cassette located at a lower stage or an upper stage than the paper feeding cassette with which a paper non-feeding error has occurred.

3. The image forming apparatus according to claim 1, wherein the prescribed period of time is a preset time corresponding to a time it takes a user to remove a paper feeding cassette from the image forming apparatus and replace a paper feeding cassette.

4. The image forming apparatus according to claim 1, wherein each paper feeding cassette of the plurality includes a common carrying passage through which a paper sheet is fed from a paper feeding cassette of the plurality located at a lower stage to the carrying passage.

5. The image forming apparatus according to claim 4, further comprising a printing mechanism part to which paper sheets are fed from the plurality of paper feeding cassettes, wherein the sensing sensor is provided at an upper stage relative to the printing mechanism part.

* * * * *